US005854538A

United States Patent [19]

Krummel

[11] Patent Number: 5,854,538

[45] Date of Patent: Dec. 29, 1998

[54] CIRCUIT ARRANGEMENT FOR ELECTRODE PRE-HEATING OF A FLUORESCENT LAMP

[75] Inventor: Peter Krummel, Traunreut, Germany

[73] Assignee: Siemens Aktiengesellschaft, Munich, Germany

[21] Appl. No.: 662,440

[22] Filed: Jun. 10, 1996

[30] Foreign Application Priority Data

Jun. 8, 1995 [DE] Germany ..... 195 20 999.0

[51] Int. Cl.[6] ..... H05B 41/36

[52] U.S. Cl. ..... 315/105; 315/DIG. 5; 315/102; 315/107

[58] Field of Search ..... 315/102, 94, 97, 315/105, 106, 107, DIG. 5

[56] References Cited

U.S. PATENT DOCUMENTS

| | | | |
|---|---|---|---|
| 3,872,350 | 3/1975 | Powell et al. | 315/104 |
| 4,682,080 | 7/1987 | Ogawa et al. | 315/209 R |
| 4,965,493 | 10/1990 | Van Meurs et al. | 315/224 |
| 5,049,783 | 9/1991 | Kroening | 315/102 |
| 5,656,891 | 8/1997 | Luger et al. | 315/94 |

FOREIGN PATENT DOCUMENTS

| | | |
|---|---|---|
| 0 429 716 A1 | 12/1989 | European Pat. Off. . |
| 0 602 719 A1 | 12/1993 | European Pat. Off. . |
| 3152951 C2 | 8/1985 | Germany . |
| 40 13 697 A1 | 10/1991 | Germany . |

*Primary Examiner*—Robert Pascal
*Assistant Examiner*—Arnold Kinkead
*Attorney, Agent, or Firm*—Hill & Simpson

[57] ABSTRACT

A circuit arrangement used with electronic ballast equipment has an inverter which supplies a high-frequency half-bridge voltage to at least one load circuit having a lamp throttle, a fluorescent lamp, an ignition capacitor, and a half-bridge capacitor. In order to pre-heat the coils of the fluorescent lamp in a short period of time, a switchable voltage source is activated. This voltage source is connected to the output of the inverter. The outputs of the voltage source are constructed as a pair, to which the electrodes and the fluorescent lamp are connected in parallel. This voltage source includes a transformer having a primary winding coupled to the inverter and is switched between non-conducting and conducting (energized) states by a switching stage. The secondary windings of the transformer are connected in parallel to the electrodes of the fluorescent lamp.

6 Claims, 1 Drawing Sheet

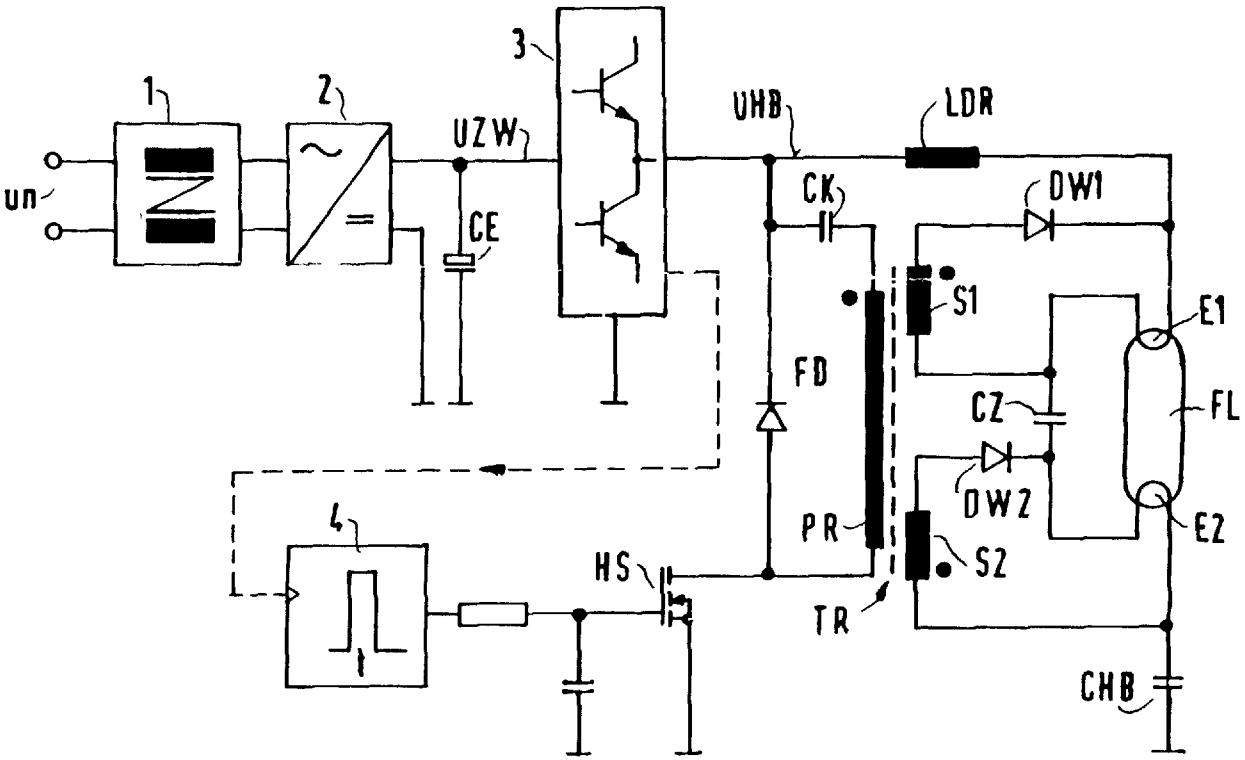
un
1
2
3
UZW
CE
UHB
LDR
DW1
CK
E1
FL
E2
S1
FD
PR
CZ
DW2
S2
TR
CHB
HS
4

CIRCUIT ARRANGEMENT FOR ELECTRODE PRE-HEATING OF A FLUORESCENT LAMP

BACKGROUND OF THE INVENTION

1. Field of the Invention

The invention relates to a circuit arrangement used with electronic ballast equipment to pre-heat the electrodes (coils) of fluorescent lamps.

2. Description of the Prior Art

In connection with electronic ballast equipment, with which a circuit of the above type is used, it is often standard practice to pre-heat the coils or the electrodes of the fluorescent lamp. The coils or electrodes are switched on to the emission temperature before the actual switching on of the lamp. This process prepares the lamp for an ignition, and thereby conserves the life of a fluorescent lamp. It is apparent that this pre-heating phase should be as short as possible, since the fluorescent lamp should be ignited with little delay upon application of the network voltage to the ballast equipment. Since a certain quantity of energy is necessary to heat of the coils of the fluorescent lamp to the emission temperature, it is necessary to increase the heating current as high as possible.

With respect to the circuitry, there are many possibilities for performing particular functions in electronic ballast equipment with a corresponding circuit outlay. For reasons of economy, however, embodiments requiring a large circuit outlay will result in only limited success in the marketplace.

Presently, the most economical circuit-oriented construction of known electronic ballast equipment incorporates a load circuit that normally includes a series resonant circuit having a lamp throttle and ignition capacitor. In this load circuit, the electrodes or the coils of the fluorescent lamp (restricting consideration to one-lamp ballast equipment, for simplicity) are connected in series. This load circuit drives an inverter having a half-bridge arrangement made of two semiconductor switches connected in series, whose common connection point forms the output of the half-bridge arrangement. The inverter produces a half-bridge voltage in the form of a high-frequency square wave pulse sequence. This sequence is supplied to the load circuit. For cost reasons, the switches of the half-bridge arrangement are usually fashioned as bipolar power transistors, whereby the inverter is constructed so that the two switches are alternatingly activated with a short switching pause.

This inverter drives the load circuit during ignition and normal operation, and can be influenced in its frequency. Frequency alterations of the half-bridge voltage are required to match the particular lamp functions in different operating states, such as pre-heating, ignition or normal operation. A disadvantage of this known circuit is that the current in the resonance circuit is connected directly to the voltage across to the lamp, and is the predetermined pre-heating current during the pre-heating phase. In order to obtain a relatively high pre-heating current, which is a precondition for a rapid heating of the electrodes of the fluorescent lamp, a correspondingly high lamp voltage is required. The lamp voltage, however, must be limited during this pre-heating phase in order to exclude premature attempts to ignite the fluorescent lamp. Thus, with the depicted circuit, only pre-heating periods of about 1.5 to 2 seconds can be achieved.

U. S. Pat. No. 5,049,783 discloses electronic ballast equipment for parallel driving of several fluorescent lamps whose construction shows a possible way of reducing the required pre-heating period. In this known circuit, the individual lamp load circuit consists of a fluorescent lamp, an ignition capacitor and a high-reactance transformer. The ignition capacitor is connected in parallel to the fluorescent lamp via first terminals of the coils. A primary winding of the high-reactance transformer is applied via a coupling capacitor to the output of the inverter that carries the half-bridge voltage, and at the other side to the ground reference potential. A secondary winding of the high-reactance transformer, connected with second terminals of the coils of the fluorescent lamp, is arranged in parallel with this lamp. The leakage inductances of the high-reactance transformer, together with the capacitance of the ignition capacitor, form a series resonant circuit of the lamp load circuit, which is tuned close to the high-frequency operating frequency of the inverter. If several lamp load circuits are provided, each of these lamp circuits has a series resonant circuit of this type, whereby the secondary windings of the high-reactance transformers are connected in series in such a way that a DC circuit is formed, in which the electrodes of the fluorescent lamps and the secondary windings lie in series with one another.

In order to achieve a high heating power, this DC circuit is connected to the supply voltage of the inverter (usually designated as an intermediate circuit voltage) via a switch to be closed during the pre-heating period, as well as a pre-heating resistor. A time switch element is allocated to the circuit. This element is triggered by the intermediate circuit voltage that builds up when the electronic ballast circuit is activated, and holds the switch closed for the predetermined duration of the pre-heating period. Besides the expense for a high-reactance transformer (the characteristics of such a transformer being difficult to control in mass production), this known circuit has the disadvantage that it requires a galvanic separation of the lamp load circuits.

SUMMARY OF THE INVENTION

An object of the present invention is to provide a circuit for pre-heating the coil of a fluorescent lamp wherein the preconditions for a sure and rapid pre-heating of the coil of the fluorescent lamp are achieved in a simple way and with an economical circuit construction, Given the cost pressure that exists today for the manufacturing of electronic ballast equipment, the economic efficiency of the inventive solution is of essential importance. Not only is the component outlay relatively small in the inventive solution, but inexpensive components can also be used for it. Regarded functionally, the inventive solution enables the coils of the connected fluorescent lamp to be heated to the emission temperature quickly with a high heating current, despite the fixed lamp voltage, which is relatively low during the pre-heating phase. The inventive solution thus offers the possibility of realizing pre-heating periods not achievable with conventional solutions, in a range of less than 0.5 s.

BRIEF DESCRIPTION OF THE DRAWINGS

An exemplary embodiment of the invention is specified more precisely below on the basis of the drawing.

FIG. 1 is a schematic diagram of electronic ballast equipment, incorporating the invention.

DETAILED DESCRIPTION OF THE PREFERRED EMBODIMENTS

A harmonic filter 1, connected to an AC supply voltage un, is shown schematically in the drawing. The filter 1 is an interference suppression filter and serves to limit perturbations of the supply network due to high-frequency interference voltages, which arise as a result of switching processes in the electronic ballast equipment. A rectifier arrangement 2 is connected to the output of this harmonic filter 1. The rectifier 2 contains a sine correction circuit and transforms the AC supply voltage un into a rectified voltage. A corrected direct voltage, connected to a ground reference potential GND, is emitted at the output of the rectifier arrangement 2, which is supplied to one terminal of a back-up capacitor CE, which can be an electrolytic capacitor. The other terminal of the back-up capacitor CE is at ground reference potential. In this way, a stabilized intermediate circuit voltage UZW, not affected by modulations of the AC supply voltage un, is produced for the continuous supply of a inverter 3. In general, the inverter 3 includes a half-bridge arrangement of two power transistors T1, T2 preferably of bipolar construction, which are arranged between the intermediate circuit voltage UZW and ground reference potential GND via their respective controlled current paths, which are connected in series. The two power transistors T1, T2 are controlled so that they are alternatingly switched so that one is conductive while the other is non-conductive. At the common point of connection of the current paths of these two power transistors T1, T2, a high-frequency pulse sequence is produced which forms the output signal of the inverter 3, this pulse sequence being designated as half-bridge voltage UHB.

This half-bridge voltage UHB forms the voltage supply for a lamp load circuit connected to the inverter 3. This load circuit is a series resonant circuit arranged between the output of the inverter 3 and ground reference potential GND, and includes a lamp throttle (inductance) LDR, a fluorescent lamp FL and a half-bridge capacitor CHB. In addition, an ignition capacitor CZ lying parallel to the fluorescent lamp FL is provided. The capacitor CZ is connected to the electrodes E1, E2 of the fluorescent lamp FL.

As described above, the circuit arrangement for electronic ballast equipment for driving at least one fluorescent lamp is known, a more detailed representation and description is thus not necessary here.

The inverter 3 controls all operating functions of the fluorescent lamp FL in the lamp load circuit. After activation of the electronic ballast equipment through the application of the AC supply voltage un, the series resonant circuit of the lamp load circuit is operated during a pre-heating period, for switching on the fluorescent lamp FL in a power-conserving manner, with a frequency that lies above the resonance frequency. A high current flows via the electrodes E1, E2 of the fluorescent lamp FL to heat the lamp FL to the emission temperature as quickly as possible. The voltage present at the fluorescent lamp FL, however, can not be too high, so that a premature ignition does not occur. As soon as the electrodes E1, E2 of the fluorescent lamp FL are brought to the emission temperature at the end of the pre-heating period, the fluorescent lamp FL should ignite as quickly as possible. For this purpose, an ignition voltage is required that is significantly higher than the normal operating voltage of the fluorescent lamp FL. This high voltage is produced by reducing the frequency of the half-bridge voltage UHB so that the series resonant circuit of the lamp load circuit is operated close to its resonant frequency. As soon as the fluorescent lamp FL ignites, a high current flows in the lamp load circuit, limited by the reactance of the lamp throttle LDR. An operating circuit of this type for a fluorescent lamp also permits a dimming function, in which the fluorescent lamp FL emits only a predetermined portion of its nominal luminous flux. The operating frequency of the inverter 3 is raised in a defined way, to increase the effective reactance of the lamp throttle LDR. The current through the fluorescent lamp FL is limited so that the lamp FL emits only the predetermined portion of its nominal luminous flux.

In the above-described operating steps, the pre-heating of the electrodes E1, E2 of the fluorescent lamp FL is of particular interest. During this pre-heating period the voltage at the fluorescent lamp FL can not exceed a defined value, in order to preclude premature ignition with coils that are not yet sufficiently heated. The inverter 3 is controlled during the predetermined pre-heating period to supply the half-bridge voltage UHB, having pulse frequency that lies above the resonant frequency of the series resonant circuit in the lamp load circuit. At this high frequency, the lamp throttle LDR has a current-limiting effect. Conditioned by the circuit arrangement in the lamp load circuit, an upper limit is present for the heat power that can be supplied to the electrodes E1, E2 of the fluorescent lamp FL, so that the pre-heating period is sufficiently extended.

In order to meet this difficulty, in the exemplary embodiment shown in the drawing an internal voltage source, which is supplied via the half-bridge voltage UHB and which can be activated during the pre-heating period, is allocated to the lamp load circuit. This voltage source includes a transformer TR having a primary winding PR, which is directly connected to the output of the inverter 3 via a coupling capacitor CK. The other terminal of the primary winding PR is set to ground reference potential via the conductive path of a semiconductor switch HS. The switch HS is a field-effect transistor. A switch timing element 4 is connected to the control input of this semiconductor switch HS via a matching network. A free-running (not biased) diode FD is connected in parallel with the series circuit of the coupling capacitor CK and the primary winding PR of the transformer TR.

The secondary side of the transformer TR is formed by two secondary windings S1, S2 that are synchronized in their winding direction. The winding direction of the primary and secondary windings PR, S1, S2 of the transformer TR is symbolically indicated in the drawing. Each of the secondary windings S1, S2 of the transformer TR is directly connected, with one terminal, to one of the two electrodes E1 or E2 of the fluorescent lamp FL. The two electrodes E1 and E2 are also each located in a circuit branch between the winding end the other terminal, which is connected with the ignition capacitor CZ, these branches respectively also including rectifier diodes DW1 and DW2.

The function of the described circuit arrangement will now be explained in greater detail. In the normal case, a switching-on process for the fluorescent lamp FL is triggered by the application of the supply voltage un to the electronic ballast equipment. The intermediate circuit voltage UZW builds up at the back-up capacitor CE, and the inverter 3 is activated. For the duration of the given pre-heating period, the frequency of the half-bridge voltage UHB lies far above the resonant frequency of the series resonant circuit in the lamp load circuit, so that the voltage across the fluorescent lamp FL is significantly lower than the ignition voltage. With the beginning of the pre-heating period, the switch timing element 4 is triggered, in order to switch the semiconductor switch HS to a conducting state for the duration of the pre-heating of the electrodes E1, E2 of the fluorescent lamp FL.

There are different possibilities for the generation of a triggering signal for the switch timing element 4 during the start-up of the electronic ballast equipment. Thus, the rise of the intermediate circuit voltage UZW building up at the back-up capacitor CE, or the half-bridge voltage UHB, can be used, or in another way a rise in current can be detected in the lamp load circuit, for instance it can be measured as a decrease in voltage across a resistor connected in series in the lamp load circuit. It is advantageous if the switch timing element 4 is triggered only when the inverter 3 is building up voltage. This case, shown schematically in the drawing, takes into account that the inverter 3 is some known electronic ballast equipment is automatically shut down in a malfunction state in which the connected fluorescent lamp FL is difficult or even impossible to ignite without having to shut off the supply voltage. After a change of lamps, the inverter 3 starts up again automatically in the ballast equipment without switching off the supply voltage, and attempts to ignite the exchanged fluorescent lamp. If the trigger signal for the switch timing element 4 is derived from a start/stop switch of a known type for the inverter 3, or from the corresponding alterations in the lamp load circuit at the beginning of the switching-on process, this operating function is then also unambiguously taken into account.

With the activation of the semiconductor switch HS by the switch timing element 4, the primary winding PR of the transformer TR is switched to be conducting and is supplied through the half-bridge voltage UHB. The output voltages of the transformer TR at the secondary windings S1 or S2 are constant and rectified via the rectifier diodes DW1, DW2, and are supplied to one of the electrodes E1, E2 of the fluorescent lamp FL. At the beginning of the pre-heating period, these electrodes E1, E2 are at a low temperature and a low resistance. This results in a high heating current, whereby the supplied heat power is extremely large, since it increases as the square of the heating current. The electrodes E1, E2 of the fluorescent lamp FL are quickly heated. The coil resistance thereby rises, and heating current and heating power decrease with rising coil temperature. Thus, it is ensured that the electrodes E1, E2 are not overheated. This occurs by selecting the transformation ratio of the transformer TR, which determines the output voltages at the secondary windings S1, S2, and setting the heating power, to achieve a correspondingly short pre-heating period. In this way, a pre-heating period of less than 0.5 s can be achieved.

After the predetermined pre-heating period has ended, the semiconductor switch HS is made non-conducting via the resting of the switch timing element 4. The transformer TR is no longer energized at the primary side, and the heating of the electrodes E1, E2 of the fluorescent lamp FL is ended. Via the free-running diode FD, residual energy that may still be present in the transformer TR is quickly allowed to decay. Corresponding to the operating function of the electronic ballast equipment, in particular to the inverter 3, after the end of the pre-heating period the frequency of the half-bridge voltage UHB is lowered. As described above, the voltage at the fluorescent lamp FL rises until the ignition voltage is achieved and the lamp FL ignites. During normal operation of the fluorescent lamp FL, the lamp throttle LDR limits the current flowing through the fluorescent lamp FL on the basis of the throttle's reactance, which is very high at this operating frequency.

From the preceding functional specification, it is apparent why the rectifier diodes DW1, DW2 are provided, since they do not seem to be absolutely necessary for the described heating function. These rectifier diodes DW1, DW2 serve to limit high voltages at the sockets of the fluorescent lamp FL, thus preventing an undesired build-up of the lamp circuit. The diodes DW1, DW2 also provide operating safety during a change of lamps with voltage present.

In the above-described exemplary embodiment of the invention, only a single lamp current circuit is connected to the electronic ballast equipment. An expansion of the specified circuit arrangement to several lamp current circuits is possible without difficulty, and without fundamentally altering anything in the specified circuit arrangement. For electronic ballast equipment for several lamps, the number of secondary windings of the transformer must be multiplied corresponding to the number of the electrodes to be heated of two or three fluorescent lamps. Given a fundamentally identical circuit construction, for electronic ballast equipment for several lamps only the number of the secondary windings of the transformer increases, as well as the number of rectifier diodes to be arranged in the heating circuit. Since electronic ballast equipment for several lamps is well known, no separate schematic graphic representation is required for the specification of such an exemplary embodiment of the invention, having more than one fluorescent lamp operated via an electronic ballast equipment.

I claim as my invention:

1. A circuit arrangement for pre-heating electrodes of at least one flourescent lamp operated with electronic ballast equipment, said electrodes being respectively disposed at opposite ends of said flourescent lamp, the circuit arrangement comprising:

means for supplying a stabilized intermediate circuit voltage;

inverter means for emitting a half-bridge voltage in the form of a high frequency pulse sequence, said inverter means having an input connected to said means for supplying a stabilized intermediate circuit voltage and having an output;

a load circuit including a lamp throttle, connected to a first of said electrodes, an ignition capacitor connected across said electrodes, and a half-bridge capacitor connected to a second of said electrodes, said load circuit connected between said output of said inverter and a ground reference potential;

a switchable voltage source including a transformer having a primary winding, connected to said output of said inverter and to said ground reference potential, said switchable voltage source further comprising secondary windings having outputs connected in parallel with said electrodes, said secondary windings having a synchronized winding direction; and means, connected to said switchable voltage source, for activating said switchable voltage source during a predetermined pre-heating period of said electrodes.

2. The circuit arrangement in claim 1 wherein said means for activating said switchable voltage source further comprises:

a time-dependent switching element connected in series to said primary winding.

3. The circuit arrangement in claim 2, wherein said time-dependent switching element is a thermistor.

4. The circuit arrangement in claim 2, wherein said time-dependent switching element further comprises:

a semiconductor switch having a conductive path connected in series with said primary winding and an input; and a time switch element having an output connected to said input of said semiconductor switch.

5. The circuit arrangement in claim 1 further comprising a rectifier diode connected in series with each of said secondary windings.

6. The circuit arrangement in claim 1, further comprising a free-running diode connected in parallel with said primary winding.

* * * * *